US011857059B2

(12) United States Patent
Lee et al.

(10) Patent No.: US 11,857,059 B2
(45) Date of Patent: Jan. 2, 2024

(54) COMPACT CONTAINER HAVING IMPROVED OPENING/CLOSING STRUCTURE FOR DIFFERENT COSMETIC MATERIALS

(71) Applicant: PUM-TECH KOREA CO., LTD, Incheon (KR)

(72) Inventors: Do Hoon Lee, Incheon (KR); Sam Mul Jung, Seoul (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 661 days.

(21) Appl. No.: 17/045,960

(22) PCT Filed: Apr. 1, 2019

(86) PCT No.: PCT/KR2019/003773
§ 371 (c)(1),
(2) Date: Oct. 7, 2020

(87) PCT Pub. No.: WO2019/203475
PCT Pub. Date: Oct. 24, 2019

(65) Prior Publication Data

US 2021/0120937 A1 Apr. 29, 2021

(30) Foreign Application Priority Data

Apr. 17, 2018 (KR) ..... 10-2018-044207

(51) Int. Cl.
*A45D 40/24* (2006.01)
*A45D 33/00* (2006.01)
(Continued)

(52) U.S. Cl.
CPC ..... *A45D 40/24* (2013.01); *A45D 33/008* (2013.01); *A45D 40/221* (2013.01); *B65D 25/02* (2013.01);
(Continued)

(58) Field of Classification Search
CPC ..... A45D 40/24; A45D 40/26; A45D 40/221–222; A45D 33/006;
(Continued)

(56) References Cited

U.S. PATENT DOCUMENTS 1,460,950 A * 7/1923 Name ..... A45D 33/006 132/295
1,688,042 A * 10/1928 Name ..... A45D 33/006 206/229
(Continued)

FOREIGN PATENT DOCUMENTS

EP 1479311 A1 * 11/2004 ..... A45D 33/008
KR 200404842 Y1 12/2006
(Continued)

*Primary Examiner* — Chun Hoi Cheung
*Assistant Examiner* — Brijesh V. Patel
(74) *Attorney, Agent, or Firm* — Heedong Chae; Lucem, PC

(57) ABSTRACT

The present invention includes a compact container having an improved opening/closing structure for different cosmetic materials, the compact container comprising: a container body; a content container which is coupled inside the container body and is to be filled with a first content; a rotation dish coupling member coupled to the lower part of the container body; a rotation dish which is axis-coupled to the lower part of the rotation dish coupling member to be horizontally rotatable and is to be filled with a second content; an axial rotation hole formed at one side of the rotation dish; and an axial rotation part formed on the lower surface of the rotation dish coupling member and fitted in the axial rotation hole, wherein the axial rotation part and the axial rotation hole are configured to be released from or fastened to each other by the forward or backward movement of the rotation dish.

11 Claims, 8 Drawing Sheets

(51) Int. Cl.

| | |
|---|---|
| ***A45D 40/22*** | (2006.01) |
| ***B65D 25/02*** | (2006.01) |
| ***B65D 43/02*** | (2006.01) |
| ***B65D 43/16*** | (2006.01) |
| *A45D 40/00* | (2006.01) |

(52) U.S. Cl.
CPC ..... *B65D 43/0225* (2013.01); *B65D 43/16* (2013.01); *A45D 2040/0006* (2013.01); *A45D 2040/225* (2013.01); *B65D 2251/005* (2013.01); *B65D 2251/0018* (2013.01)

(58) Field of Classification Search
CPC ..... A45D 33/008; A45D 33/16; A45D 33/20; A45D 33/22; A45D 34/04; A45D 34/06; A45D 44/22; A45D 2040/0006; A45D 2040/225; A45D 2034/002; B65D 25/02; B65D 43/0225; B65D 43/16; B65D 43/165; B65D 43/18; B65D 2251/0018; B65D 2251/005; B65D 21/0209; B65D 81/32; Y10S 206/823
USPC ... 206/581, 235, 823, 229, 509, 37–38, 503; 220/4.22, 4.26–4.27, 824, 23.88, 254.4, 220/291, 816–817, 835, 840, DIG. 26; 132/293–296, 298, 287, 301, 305, 132/314–317
See application file for complete search history.

(56) References Cited

U.S. PATENT DOCUMENTS 3,188,157 A * 6/1965 Rand ..... A45D 33/00 220/23.8
3,392,868 A * 7/1968 Pfrommer ..... A45D 40/24 D9/422
3,441,033 A * 4/1969 Flax ..... A45D 33/20 132/295
3,476,123 A * 11/1969 Flax ..... A45D 33/28 132/315
4,807,773 A * 2/1989 Tsai ..... A45D 33/24 206/823
5,025,817 A * 6/1991 Wen ..... A45D 33/006 206/823
5,632,394 A * 5/1997 Mecca ..... A45C 11/00 206/823
6,070,749 A * 6/2000 Joulia ..... A45D 40/221 220/817
6,145,515 A * 11/2000 Wu ..... A45D 40/24 132/294
6,223,921 B1 * 5/2001 Huang ..... A45D 40/00 220/23.88
6,378,533 B1 * 4/2002 Roman ..... A45D 33/006 220/4.27
6,619,297 B2 * 9/2003 Sheng ..... A45D 33/20 220/4.27
6,961,977 B2 * 11/2005 Seidler ..... A45D 40/24 220/816
7,614,405 B2 * 11/2009 Allen ..... A45D 33/006 132/295
7,819,125 B2 * 10/2010 Maelstaf ..... A45D 33/006 132/294
7,934,974 B2 * 5/2011 Kelly ..... A63H 3/52 446/73
8,109,280 B2 * 2/2012 Winckels ..... A45D 40/221 132/294
8,322,354 B2 * 12/2012 Parker ..... B65D 21/0235 132/294
8,387,812 B2 * 3/2013 Delage ..... A45D 42/00 206/581
8,863,949 B2 * 10/2014 Sun ..... B25H 3/02 206/234
8,919,355 B2 * 12/2014 Blanch ..... A45D 40/221 206/823
9,289,042 B2 * 3/2016 Bellas ..... B65D 43/02
2002/0179485 A1 * 12/2002 Shih ..... A45D 40/24 206/581
2010/0319724 A1 * 12/2010 Chung ..... A45D 40/24 132/295
2014/0318569 A1 * 10/2014 Bueti ..... A45D 33/20 132/295
2021/0100333 A1 * 4/2021 Seidler ..... A45C 13/1069

FOREIGN PATENT DOCUMENTS

KR 100707925 B1 2/2007
KR 101222087 B1 1/2013
KR 101326588 B1 11/2013
KR 1020170078280 A 7/2017
KR 101836208 B1 3/2018

* cited by examiner (a)

(b)

COMPACT CONTAINER HAVING IMPROVED OPENING/CLOSING STRUCTURE FOR DIFFERENT COSMETIC MATERIALS

BACKGROUND

One aspect of the present disclosure relates to a compact container having an improved opening/closing structure for different cosmetic materials and, more specifically, to a compact container having an improved opening/closing structure for different cosmetic materials, the compact container comprising: a container body; a content container which is coupled inside the container body and is to be filled with a first content; a rotation dish coupling member coupled to the lower part of the container body; a rotation dish which is axis-coupled to the lower part of the rotation dish coupling member to be horizontally rotatable and is to be filled with a second content; an axial rotation hole formed at one side of the rotation dish; and an axial rotation part formed on the lower surface of the rotation dish coupling member and fitted in the axial rotation hole, wherein the axial rotation part and the axial rotation hole are configured to be released from or fastened to each other by the forward or backward movement of the rotation dish, so as to allow the rotation dish to be rotated after the rotation dish coupling member and the rotation dish are released from each other by pulling the rotation dish forward by a predetermined interval, and thus prevent the rotation dish from being arbitrarily rotated and opened by an external impact during the storing or carrying thereof.

In general, women do basic makeup using moisturizing skins and lotions to protect their facial skin, and then color makeup using various color cosmetics.

The color cosmetics used for the color makeup cover defects in the skin and provide a makeup effect of natural skin tone.

A user selects and uses color cosmetics having a color suitable for the user's skin color, the design and color of the clothes of the user, and a place to go, and the color cosmetics are mainly applied to the skin by a cosmetic tool such as a puff.

Such color cosmetics are used while being contained in a color cosmetic container. The cosmetic container include a container body, a container lid, a content container mounted inside the container body and hinge-coupled with a content container lid at one side, and a puff kept in the content container lid.

However, since the conventional cosmetic container has only one content container inside the container body, it is necessary to purchase and carry a separate cosmetic container to use cosmetics having various colors and functions, so that it gives the user an economic burden, and it is also inconvenient to carry.

To solve the above problems, as shown in FIG. 1, there is disclosed a compact container having a stacked structure in Korean Unexamined Patent Publication No. 10-2017-0078280, which includes a first container provided with a content storage part to store contents, a second container having the same shape and size as the first container, stacked on an upper portion of the first container, and having a storage groove in which a content application member is contained, and a cover hinge-coupled to one side of the second container to be rotatable up and down, wherein the content storage part of the first container in which a bottom surface of the second container is located below is opened and closed as the second container is rotated.

However, according to the related art, since the first container and the second container are simply rotated to be opened and closed, when keeping or carrying the compact container, the first container is arbitrarily rotated even by an external impact or small force, so that the contents contained the second container are exposed to an outside, and thus, the contents may be contaminated by external foreign substances.

In addition, according to the related art, after rotating the first container or the second container, when using while rubbing the contents contained in the second container, the second container is rotated while shaking, which is inconvenient in use.

In addition, according to the related art, the first container is rotatably coupled to the lower portion of the second container, and a plurality of contents are stored in the first container, so that when volatile contents are stored in the first container, the sealing force is poor.

SUMMARY

To solve the problems described above, an object of the present disclosure is to provide a compact container having an improved opening/closing structure for different cosmetic materials, which includes a container body; a content container which is coupled inside the container body and is to be filled with a first content; a rotation dish coupling member coupled to the lower part of the container body; a rotation dish which is axis-coupled to the lower part of the rotation dish coupling member to be horizontally rotatable and is to be filled with a second content; an axial rotation hole formed at one side of the rotation dish; and an axial rotation part formed on the lower surface of the rotation dish coupling member and fitted in the axial rotation hole, wherein the axial rotation part and the axial rotation hole are configured to be released from or fastened to each other by the forward or backward movement of the rotation dish, so as to allow the rotation dish to be rotated after the rotation dish coupling member and the rotation dish are released from each other by pulling the rotation dish forward by a predetermined interval, and thus prevent the rotation dish from being arbitrarily rotated and opened by an external impact during the storing or carrying thereof.

In addition, another object of the present disclosure is to provide a compact container having an improved opening/closing structure for different cosmetic materials, which has a structure in which a content container coupled to the inside of a container body is opened by sequentially opening a container lid and a content container lid, and a rotation dish axially coupled to a lower portion of a rotation dish coupling member is pulled forward for a certain section and then rotated to the side to be open, so that the different contents contained in the content container and the rotation dish may be selectively exposed to an outside to be used or may be used by exposing them to the outside at the same time.

In addition, still another object of the present disclosure is to provide a compact container having an improved opening/closing structure for different cosmetic materials, in which a locking groove is formed adjacent to an axial coupling part of the rotation dish coupling member, and a locking protrusion is formed adjacent to an axial coupling groove of the rotation dish to insert the locking protrusion into the locking groove, so that, when the rotation dish is rotated, the locking protrusion of the rotation dish is fitted into the locking groove of the container body at a predetermined rotation angle, thereby adjusting the rotation angle and improving the rotation feel.

In addition, still another object of the present disclosure is to provide a compact container having an improved opening/closing structure for different cosmetic materials, in which a forward/backward movement groove into which a locking protrusion of the rotation dish is inserted is formed on both sides of the axial coupling part of the rotation dish coupling member and a front stopper protrusion and a rear stopper protrusion are formed in the forward/backward moveable groove to prevent the locking protrusion from being unintentionally moved forward and backward in the forward/backward movement groove, so that the container may be stably carried or used.

According to one aspect of the present disclosure, there is provided a compact container having an improved opening/closing structure for different cosmetic materials, which includes:

a container body provided on one side thereof with a container body lid;

a content container coupled inside the container body to contain a first content therein and provided at one side thereof with a content container lid;

a rotation dish coupling member coupled to a lower portion of the container body and formed with an axial rotation part;

a rotation dish coupled to a lower portion of the rotation dish coupling member to be horizontally rotatable and to contain a second content, and formed with an axial rotation hole; and a rotation shaft coupled to the axial rotation part of the rotation dish coupling member by passing through the axial rotation hole of the rotation dish, wherein a rotation of the rotation dish is allowed or restricted as the axial rotation part of the rotation dish coupling member and the axial rotation hole of the rotation dish are released from each other or fastened to each other by a forward or backward movement of the rotation dish.

In addition, the axial rotation part of the rotation dish coupling member may include a fastening part protruding to one side and a curved rotation part formed on an opposite side of the fastening part, and the axial rotation hole of the rotation dish includes a fastening groove into which the fastening part is inserted and a rotation groove formed opposite to the fastening groove.

In addition, the compact container may further include a locking groove formed adjacent to the axial rotation part of the rotation dish coupling member, and a locking protrusion formed adjacent to the axial rotation hole of the rotation dish, wherein the locking protrusion is inserted into the locking groove.

In addition, the compact container may further include a forward/backward movement groove formed on both sides of the axial rotation part of the rotation dish coupling member, and a locking protrusion formed adjacent to the axial rotation hole of the rotation dish, wherein the locking protrusion is inserted into the forward/backward movement groove.

In addition, the compact container may further include a curved elastic slit formed adjacent to the locking protrusion of the rotation dish such that the locking protrusion is elastically moved up and down.

In addition, the compact container may further include a front stopper protrusion and a rear stopper protrusion formed in the forward/backward movement groove to limit forward and backward movements of the rotation dish.

In addition, the compact container may further include a separation preventing member for the rotation shaft, which is inserted into a center of the rotation shaft to prevent the rotation shaft from being separated from the rotation dish coupling member while being shrunk inward.

In addition, the compact container may further include a lower plate coupled to the lower portion of the rotation dish.

In addition, the lower plate and the rotation shaft may be integrally formed.

In addition, the axial rotation part formed in the rotation dish coupling member may be released from the axial rotation hole formed in the rotation dish by pulling the rotation dish forward and a second content may be exposed to an outside by horizontally rotating the rotation dish.

According to the compact container having an improved opening/closing structure for different cosmetic materials of the present disclosure, the content container is coupled inside the container body and is to be filled with the first content, the rotation dish coupling member is coupled to the lower part of the container body; the rotation dish is axis-coupled to the lower portion of the rotation dish coupling member to be horizontally rotatable and is to be filled with the second content, the axial rotation hole is formed at one side of the rotation dish, and the axial rotation part is formed on the lower surface of the rotation dish coupling member and fitted in the axial rotation hole, wherein the axial rotation part and the axial rotation hole are configured to be released from or fastened to each other by the forward or backward movement of the rotation dish, so as to allow the rotation dish to be rotated after the rotation dish coupling member and the rotation dish are released from each other by pulling the rotation dish forward by a predetermined interval, and thus prevent the rotation dish from being arbitrarily rotated and opened by an external impact during the storing or carrying thereof.

In addition, according to the compact container having an improved opening/closing structure for different cosmetic materials of the present disclosure, the content container coupled to the inside of a container body is opened by sequentially opening a container lid and a content container lid, and the rotation dish axially coupled to a lower portion of a rotation dish coupling member is pulled forward for a certain section and then rotated to the side to be open, so that the different contents contained in the content container and the rotation dish may be selectively exposed to an outside to be used or may be used by exposing them to the outside at the same time.

In addition, according to the compact container having an improved opening/closing structure for different cosmetic materials of the present disclosure, the locking groove is formed adjacent to the axial coupling part of the rotation dish coupling member, and the locking protrusion is formed adjacent to the axial coupling groove of the rotation dish to insert the locking protrusion into the locking groove, so that, when the rotation dish is rotated, the locking protrusion of the rotation dish is fitted into the locking groove of the container body at a predetermined rotation angle, thereby adjusting the rotation angle and improving the rotation feel.

In addition, according to the compact container having an improved opening/closing structure for different cosmetic materials of the present disclosure, the forward/backward movement groove into which a locking protrusion of the rotation dish is inserted is formed on both sides of the axial coupling part of the rotation dish coupling member and the front stopper protrusion and the rear stopper protrusion are formed in the forward/backward moveable groove to prevent the locking protrusion from being unintentionally moved forward and backward in the forward/backward movement groove, so that the container may be stably carried or used.

DETAILED DESCRIPTION OF THE EMBODIMENTS

Technical objects to be achieved by the present disclosure and embodiments of the present disclosure will be apparent through preferable embodiments to be described below. Hereinafter, a compact container having an improved opening/closing structure for different cosmetic materials according to an embodiment of the present disclosure will be described with reference to accompanying drawings.

Figure 1:
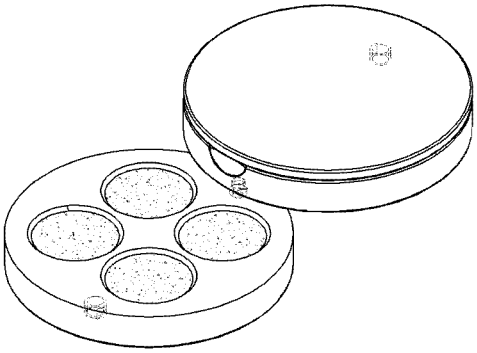
FIG. 1 is a perspective view showing a compact container according to the related art.
Figure 1:
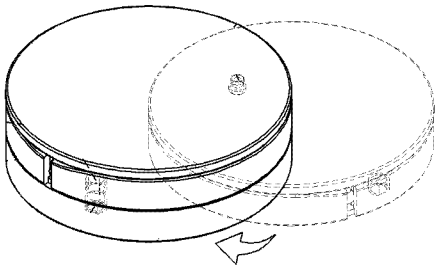
Figure 2:
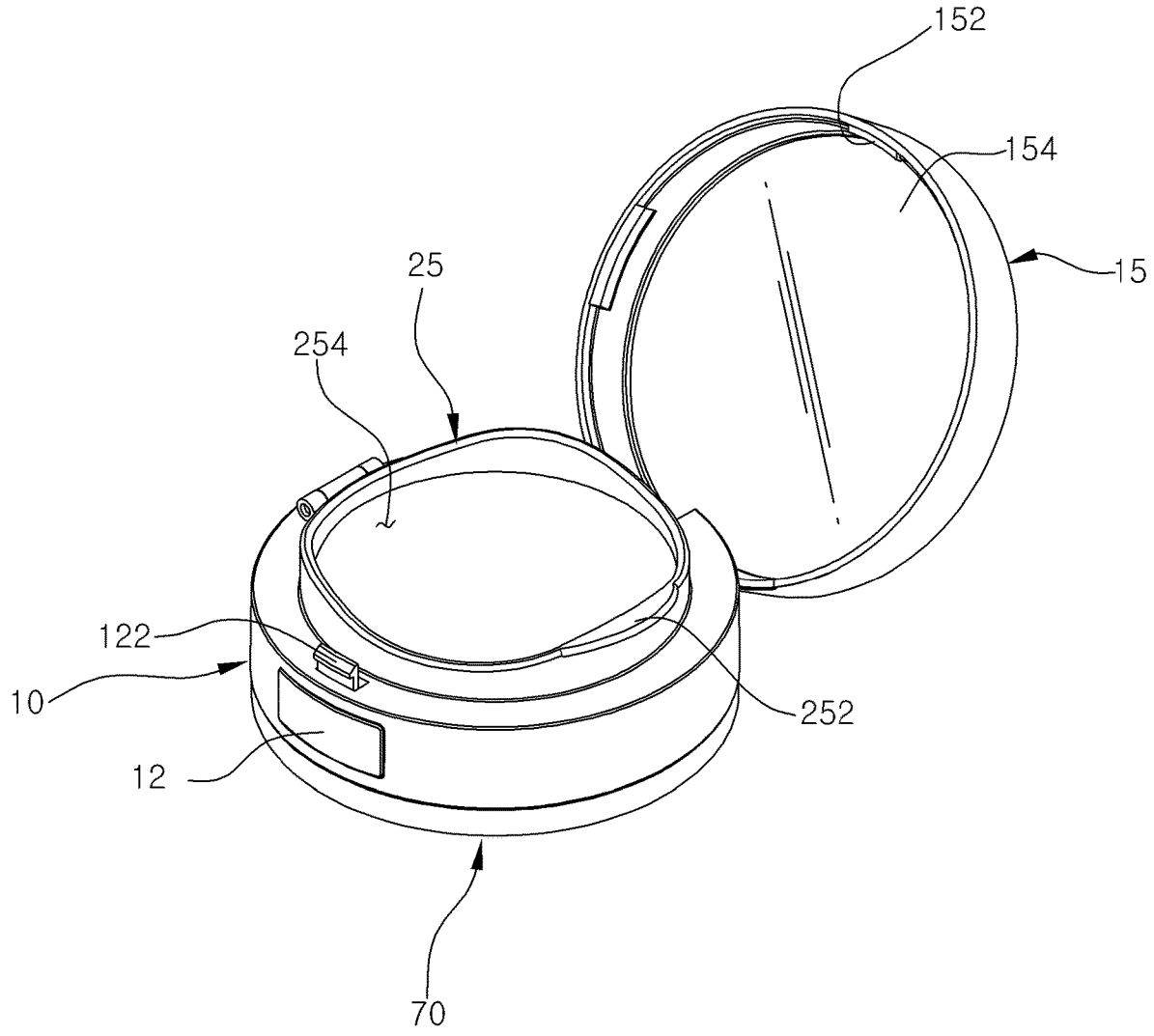
FIG. 2 is a perspective view of a compact container according to an embodiment of the present disclosure.
Figure 3:
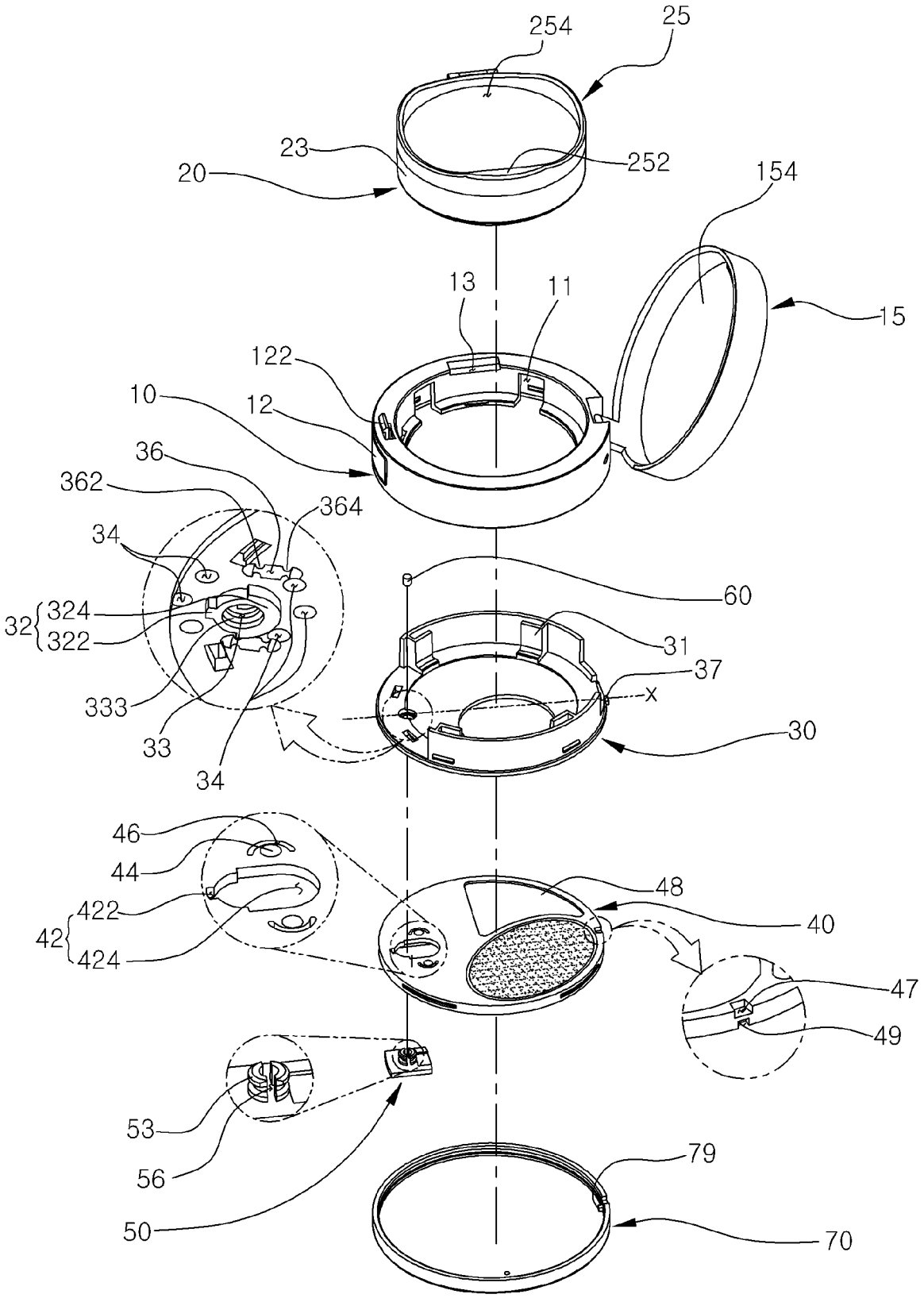
FIG. 3 is an exploded perspective view of a compact container according to an embodiment of the present disclosure.
Figure 4:
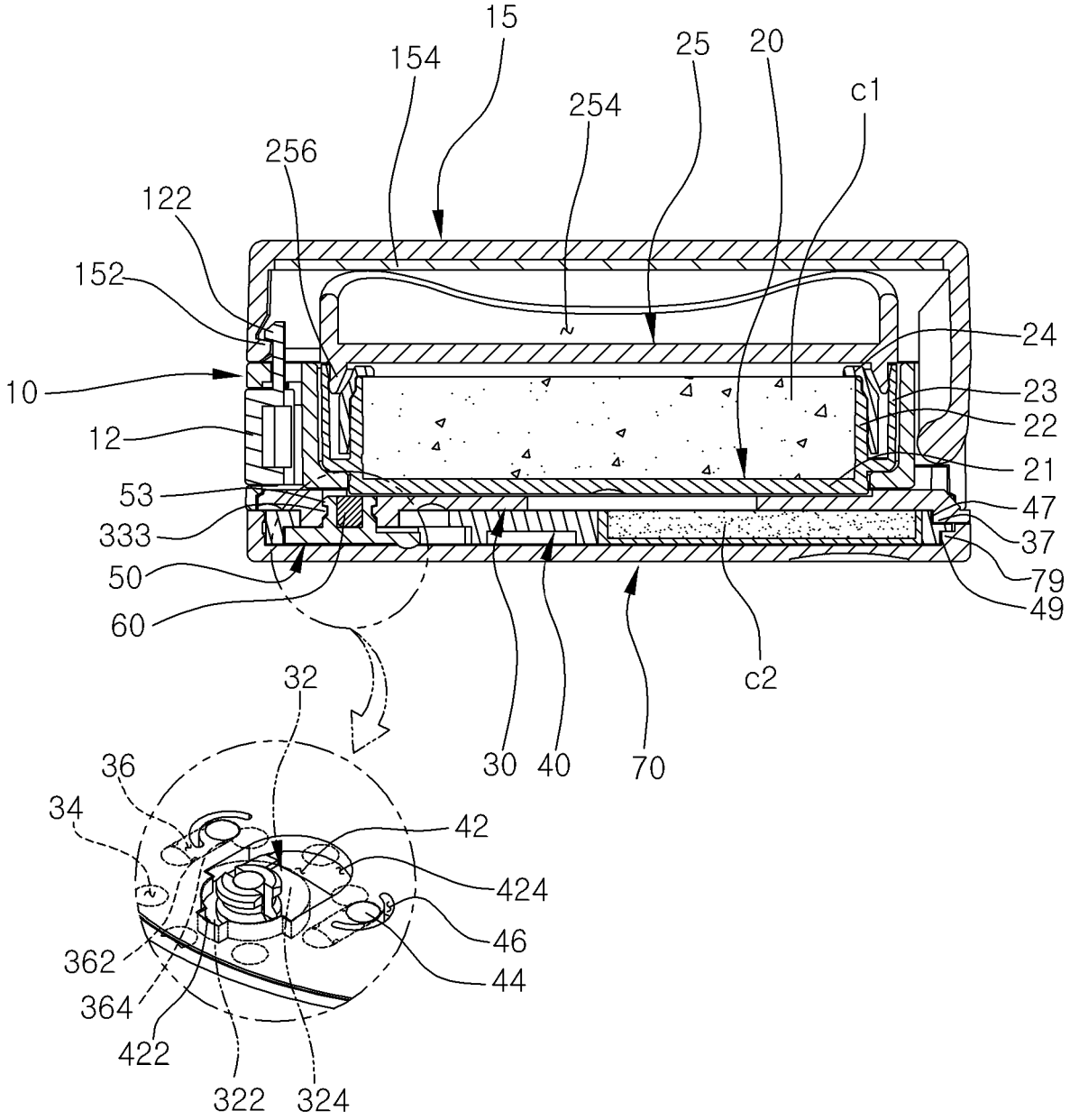
FIG. 4 is a cross-sectional view of a compact container according to an embodiment of the present disclosure.

FIG. 2 is a perspective view of a compact container according to an embodiment of the present disclosure. FIG. 3 is an exploded perspective view of a compact container according to an embodiment of the present disclosure. FIG. 4 is a cross-sectional view of a compact container according to an embodiment of the present disclosure.

A compact container having an improved opening/closing structure for different cosmetic materials according to an embodiment of the present disclosure includes a container body 10 formed with an axial rotation part 32, a container body lid 15 for opening/closing the container body 10, a content container 20 coupled inside the container body lid 15 to contain a first content, a content container lid 40 for opening/closing the content container 30, a rotation dish 40 axially coupled to a lower portion of the container body 10 to be horizontally rotatable and to contain a second content and formed with an axial rotation hole 52, and a rotation shaft 50 coupled to an axial rotation part 32 of the container body 10 while passing through the axial rotation hole 52.

As shown in FIG. 3, the container body 10 has an open upper portion and a lower portion, and is coupled to the container body lid 15 at the inside thereof to be opened and closed by the rotation of the container body lid 15.

A button 12 is formed on a front surface of the container body 10, and formed with a first locking hook 122 which is retracted by a user's pressing operation.

A hinge insertion groove 13 into which a hinge coupling portion of the content container 20 and the content container lid 25 is inserted is formed on one side of the upper portion of the container body 10.

The container body lid 15 is coupled to one side of the container body 10 to open and close the container body 10 as shown in FIG. 2. In the drawings of the compact container according to one aspect of the present disclosure, the container body lid 15 is hinged to the container body 10 to open and close the container body 10 through rotation, but the embodiment is not limited thereto, and the container body lid 15 may open and close the container body 10 in various schemes such as undercut coupling, screw coupling, or the like.

As shown in FIG. 4, a second locking hook 152, which has a protrusion shape and is fastened to the first locking hook 122 of the container body 10, is formed on one side of the container body lid 15.

In addition, a mirror 154 may be formed on an inner side surface of the container body lid 15 such that the user can easily apply makeup while illuminating the makeup area.

The content container 20 is coupled to the inside of the container body 10, and the first contents C1 are contained therein. The first content C1 is preferably a gel-type cosmetic material or an impregnation member impregnated with a gel-type cosmetic material.

The content container 20 includes a bottom surface 21, an inner wall 22 extending upward from the bottom surface 21, and an outer wall 23 spaced apart from the inner wall 22 toward an outside by a predetermined interval and extending upward. When an impregnation member is embedded in the content container 20, a fixing member 24 may be further coupled to the inner wall 22 to prevent separation of the impregnation member.

The content container lid 25 for opening and closing the content container 20 is hinge coupled to one side of the content container 20. When the content container 20 is coupled to the inside of the container body 10, the hinge coupling portion is inserted into the hinge insertion groove 13 formed at one side of the container body 10.

A lid handle 252 protrudes outward on the opposite side of the hinge coupling portion of the content container lid 25 such that the user can easily grip the content container lid 25, and a puff keeping space 254 capable of keeping a cosmetic tool such as a puff is formed in an upper portion of the content container lid 25.

In addition, a sealing protrusion wheel 256 is formed in the lower portion of the content container lid 25. While the sealing protrusion wheel 256 is forcibly fitted to an inner periphery of the outer wall 23 of the content container 20, the content container 20 is sealed.

The rotation dish coupling member 30 is fixedly coupled to the lower portion of the container body 10.

As shown in FIG. 3, a coupling position guide part 31 is formed on an upper inner periphery of the rotation dish coupling member 30 and is inserted into a coupling position guide groove 11 formed inside the container body 10.

An axial rotation part 32 inserted into an axial rotation hole 42 of the rotation dish 40 is formed on the lower surface of the rotation dish coupling member 30. The axial rotation part 32 includes a fastening part 322 protruding to one side and a curved rotation part 324 formed at the opposite side of the fastening part 322.

A coupling hole 33 into which the rotation shaft 50 is inserted is formed in the center of the axial rotation part 32, and a first locking protrusion wheel 333 coupled to the rotation shaft 50 is formed on the inner periphery of the coupling hole 33.

A locking groove 34 is formed adjacent to the axial rotation part 32, and the locking groove 34 is fitted with a locking protrusion 44 of the rotation dish 40. It is preferable that the locking groove 34 is formed in plural and located around the axial rotation part 32.

In addition, there is a forward/backward movement groove 36 formed on both sides of the axial rotation part 32, and the locking protrusion 44 of the rotary dish 40 is inserted into the forward/backward movement groove 36 to guide the forward and backward movements of the rotation dish 40. Therefore, preferably, the forward/backward movement groove 36 is longitudinally formed in the longitudinal direction of an axis 'x' connecting the axial rotation part 32 from the center of the rotation dish coupling member 30.

A front stopper protrusion 362 and a rear stopper protrusion 364 are formed inside the forward/backward movement groove 36 so that the locking protrusion 44 of the rotation dish 40 is restricted from unintentionally moving forward and backward in the forward/backward movement groove 36 of the rotation dish coupling member 30.

In addition, a first fixing protrusion 37 is formed on an outer periphery of the rotation dish coupling member 30 as shown in FIG. 3.

The rotation dish 40 is axially coupled to the bottom portion of the container body 10 to be horizontally rotatable, as shown in FIG. 4.

The second content C2 is contained in the upper portion of the rotation dish 40, and the second content C2 is preferably a powder or solid type cosmetic material. In addition, as shown in FIG. 3, a pallet 48 for mixing the first and second contents C1 and C2 may be formed adjacent to the second contents C2 filled in the rotation dish 40.

An axial rotation hole 42 into which the axial rotation part 32 of the rotation dish coupling member 30 is inserted is formed at one side of the rotation dish 40, and the axial rotation hole 42 includes a fastening groove 422 into which a coupling portion 322 of the axial rotation part 32, and a rotation groove 424 formed at an opposite side of the fastening groove 422. The axial rotation hole 42 is preferably formed longer than the axial rotation part 32 in the longitudinal direction of the axis 'x' connecting the axial rotation part 32 from the center of the rotation dish coupling member 30. Thus, as the axial rotation part 32 moves forward or backward, the position of the axial rotation part 32 is changed in the direction of the fastening groove 422 or the rotation groove 424 inside the axial rotation hole 42.

A locking protrusion 44 is formed adjacent to the axial rotation hole 42 of the rotation dish 40, and the locking protrusion 44 is fitted into the groove 34 and the front and rear moving groove 36 of the rotation dish coupling member 30 when the rotation dish 40 is rotated.

As shown in FIG. 3, a curved elastic slit 46 is formed adjacent to the locking protrusion 44 of the rotation dish 40. The curved elastic slit 46, which is a gap having a curved shape surrounding a portion of the locking protrusion 44 from the outside of the locking protrusion 44, allows the locking protrusion 44 to be fitted into the locking groove 34 and the forward/backward moveable groove 36 of the rotation dish coupling member 30 while elastically moving up and down when the rotation dish 40 is rotated.

In addition, a first fixing groove 47 and a second fixing groove 49 are formed on the outer periphery of the rotation dish 40. The first fixing groove 47 of the rotation dish coupling member 30 is inserted into the first fixing groove 47, and a second fixing protrusion 79 of a lower plate 70 is inserted into the second fixing groove 49. Accordingly, the lower plate 70 does not spin on the rotation dish 40 with no traction does not rotate. In addition, before the rotation dish 40 is moved forward, the rotation plate 40 may be prevented from being rotated on the rotation dish coupling member 30 by the fastening of the first fixing groove 47 and the first fixing protrusion 37, and the rotating dish 40 may be rotated only after the rotating dish 40 is moved forward and the fastening of the first fixing groove 47 and the first fixing protrusion 37 is released.

A pallet 48 for mixing the first and second contents may be formed on the rotation dish 40. The pallet 48 is preferably formed adjacent to the second content (C2) for ease of use.

Figure 8:
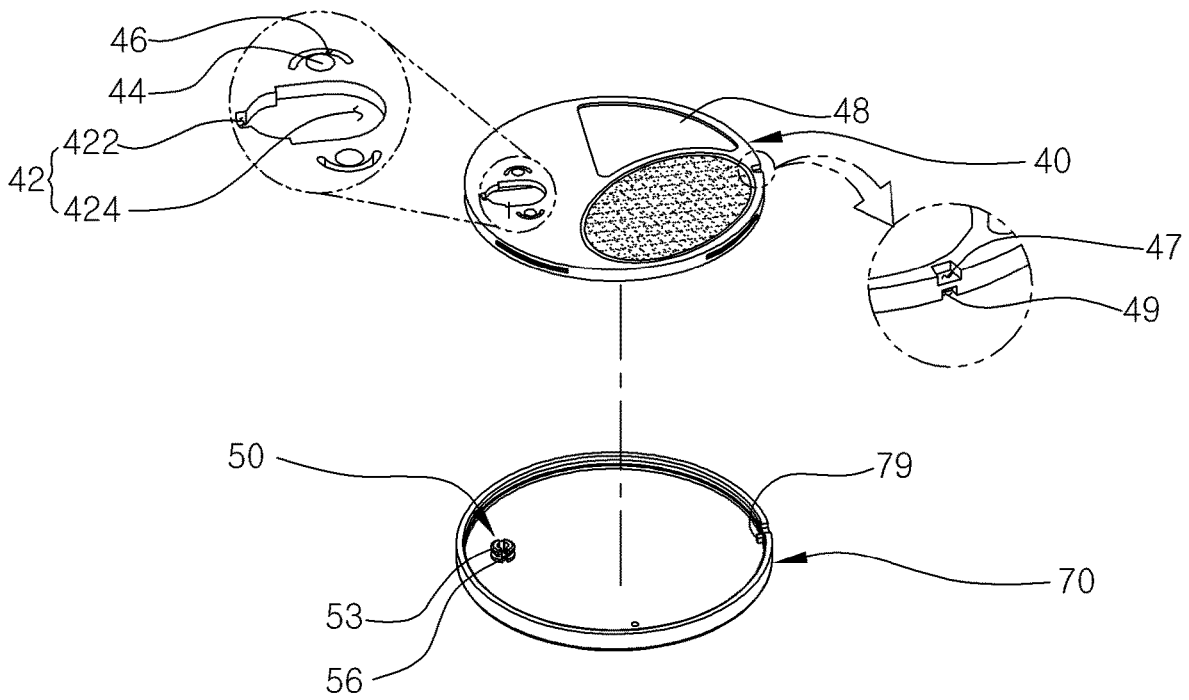
FIG. 8 is a partial perspective view of a compact container according to another embodiment of the present disclosure.

FIG. 8 is a partial perspective view of a compact container according to another embodiment of the present disclosure.

As shown in FIG. 4, the rotation shaft 50 passes through the axial rotation hole 42 of the rotation dish 40 and is coupled to the coupling hole 33 of the rotation dish coupling member 30. The rotating shaft 50 serves as a shaft through which the rotation dish 40 is rotated.

A second locking protrusion wheel 53 is formed on the upper outer periphery of the rotation shaft 50 to be undercut coupled to the first locking protrusion wheel 333 of the rotation dish coupling member 30.

The outer periphery of the rotation shaft 50 is formed with an elastic slit 56 in the form of a gap cut vertically. The elastic slit 56 is easily inserted into the coupling hole 33 of the rotation dish coupling member 30 while the rotation shaft 50 shrinks elastically inward when the rotation shaft 50 and the rotation dish coupling member 30 are coupled.

In addition, a separation preventing member 60 is fitted in the center of the rotation shaft 50, and the separation preventing member 60 prevents the rotation shaft 50 from being shrunk inward, so that the rotation shaft 50 is prevented from being separated from the container body 10.

The lower plate 70 is fixedly coupled to the lower portion of the rotation dish 40 and rotates horizontally together with the rotation dish 40. A second fixing protrusion 79 is formed on the outer periphery of the lower plate 70 and is inserted into the second fixing groove 49 of the rotation dish 40.

As shown in FIG. 3, the rotation shaft 50 may be coupled between the rotation dish 40 and the lower plate 70, and as shown in FIG. 8, the rotation shaft 50 may be integrated with the lower plate 70.

Hereinafter, a method of assembling the compact container having an improved opening/closing structure for different cosmetic materials configured as described above will be described.

In order to assemble the compact container according to one aspect of the present disclosure, the container body lid 15 is hinge-coupled to one side of the container body 10 as shown in FIGS. 3 and 4.

Next, the first content C1 is filled in the content container 20, and after the content container lid 25 is hinge-coupled to one side of the content container 20, the content container 20 is coupled to the central inside of the container body 10.

Next, the rotation dish coupling member 30 is fixedly coupled to the lower side of the container body 10, and the coupling position guide portion 31 of the rotation dish coupling member 30 is inserted into the coupling position guide groove 11 of the container body 10.

Next, the rotation dish 40 is axially coupled to the lower portion of the rotation dish coupling member 30 to be horizontally rotatable. First, the second content C2 is filled on the upper surface of the rotation dish 40, and After the axial rotation part 32 of the rotation dish coupling member 30 passes through the axial rotation hole 42 of the rotation dish 40, the rotation shaft 50 is coupled to the coupling hole 33 of the axial rotation part 32 passing through the axial rotation hole 42. In this case, since the rotation shaft 50 is formed with the elastic slit 56, while being elastically shrunk inward, the rotation shaft 50 is inserted into and coupled to the coupling hole 33 of the rotation dish coupling member 30.

Next, the lower plate 80 is coupled to the lower side of the rotation dish 40. The first fixing protrusion 37 of the rotation dish coupling member 30 is inserted into the first fixing groove 47 of the rotation dish 40, and the second fixing protrusion 79 of the lower plate 70 is inserted into the second fixing groove 49 of the rotation dish 40.

Lastly, by rotating the container body lid 15 hinge-coupled to one side of the container body 10 to close the container body 10, the assembly of the compact container having an improved opening/closing structure for different cosmetic materials according to one aspect of the present disclosure is completed.

A method of using a compact container having an improved opening/closing structure for different cosmetic materials assembled in the above manner will be described with reference to the drawings.

Figure 5:
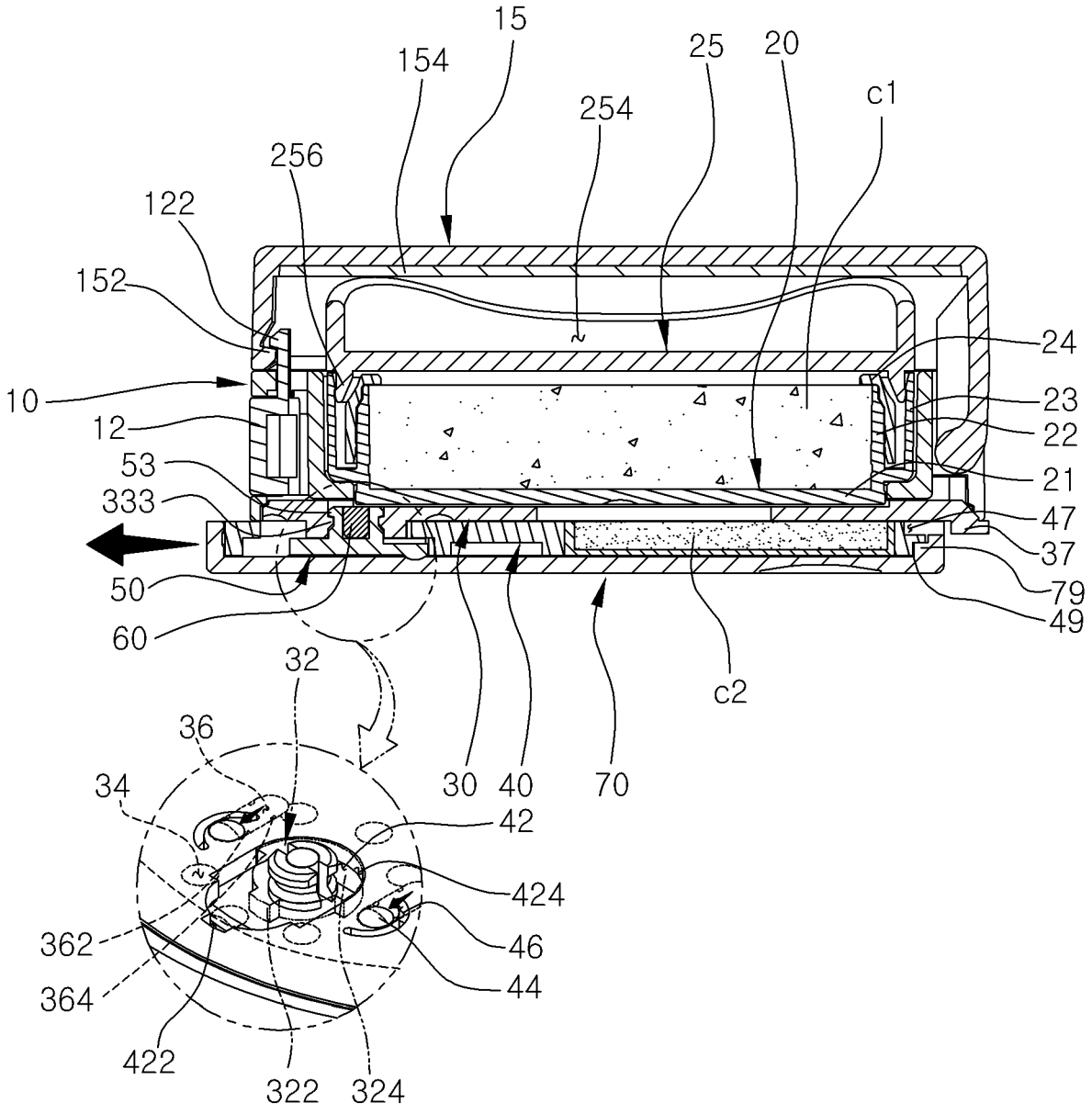
FIG. 5 is a cross-sectional view showing a state of pulling a rotation dish of a compact container forward according to an embodiment of the present disclosure.
Figure 6:
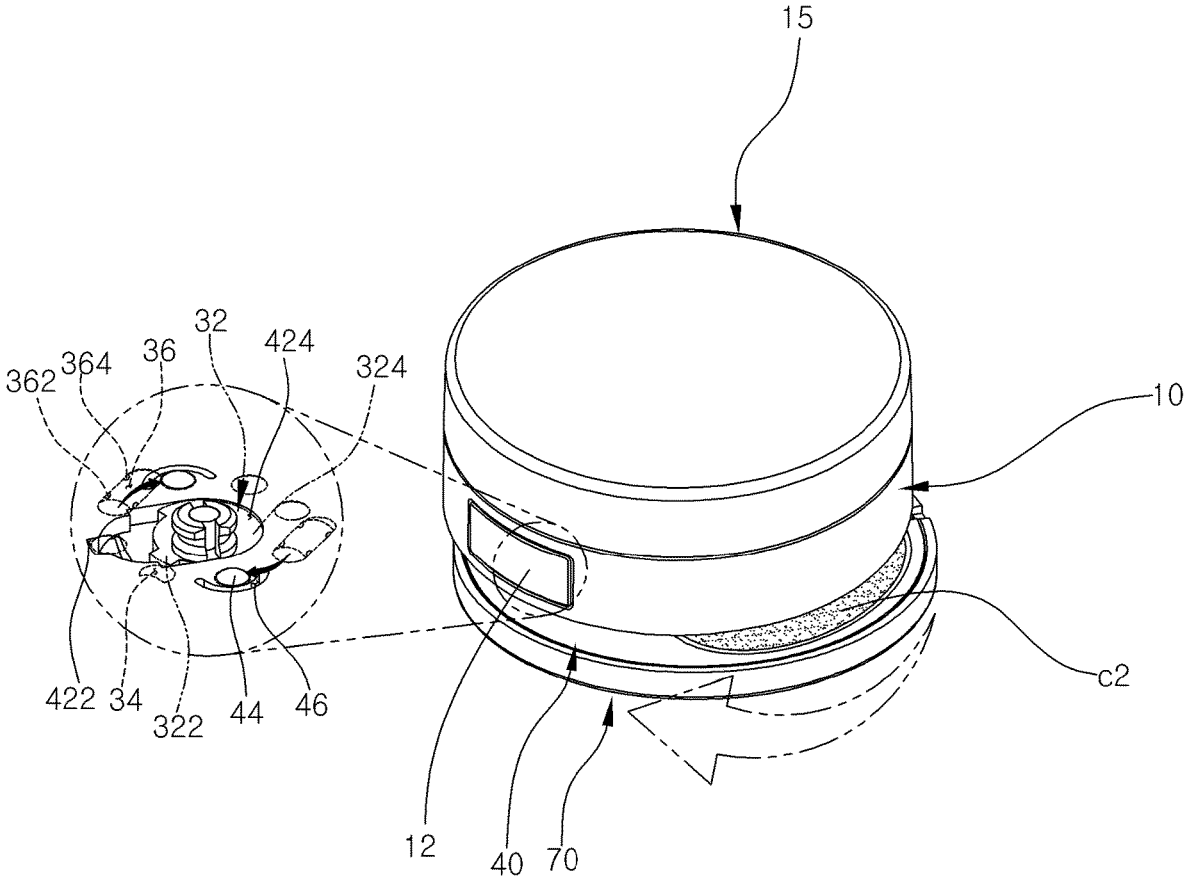
FIG. 6 is a perspective view showing a state of horizontally rotating the rotary dish of a compact container according to an embodiment of the present disclosure.
Figure 7:
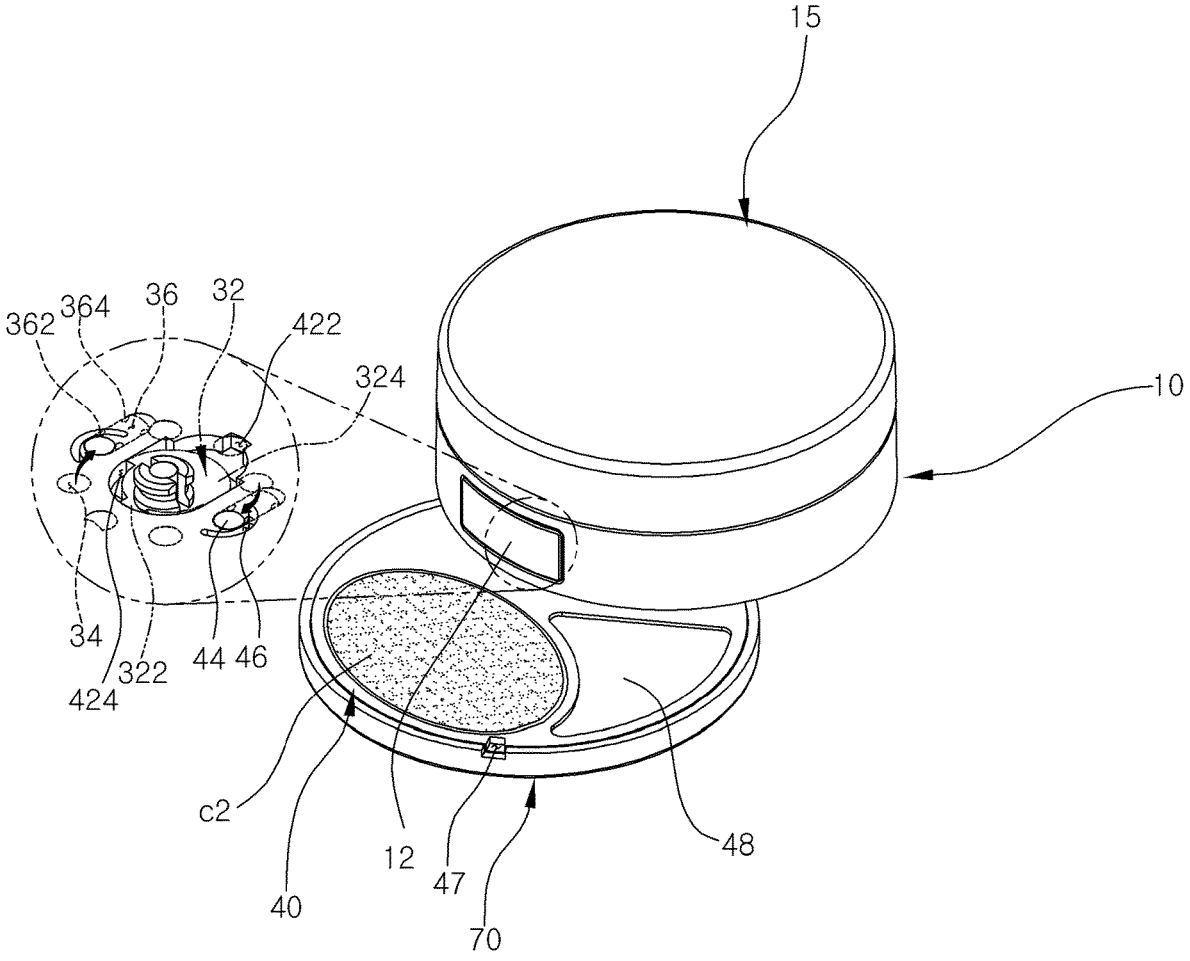
FIG. 7 is a perspective view showing a state in which the rotation dish of a compact container according to an embodiment of the present disclosure is rotated horizontally at 180 degrees.

FIG. 5 is a cross-sectional view showing a state of pulling a rotation dish of a compact container forward according to an embodiment of the present disclosure. FIG. 6 is a perspective view showing a state of horizontally rotating the rotary dish of a compact container according to an embodiment of the present disclosure. FIG. 7 is a perspective view showing a state in which the rotation dish of a compact container according to an embodiment of the present disclosure is rotated horizontally at 180 degrees.

In order to use the compact container according to the present disclosure, the button 12 formed on one side of the container body 10 is first pressed to release the fastening of the container body 10 and the container body lid 15, and the container body lid 15 is rotated to open the container body 10 as shown in FIG. 2.

Thereafter, the puff kept in the puff keeping space 254 of the content container lid 25 is grasped, and the first content C1 contained in the content container 20 is exposed to the outside by lifting the content container lid 25. Then, the first content C1 is stuck with the puff and applied to the skin.

Thereafter, when applying the second content C2 contained in the rotation dish 40 to the skin, or mixing the first and second contents C1 and C2 to apply the mixture to the skin, the rotation dish 40 is pulled forward, thereby unfastening the axial rotation part 32 formed in the rotation dish coupling member 30 and the axial rotation hole 42 formed in the rotation dish 40. Then, after the second content C2 is exposed to the outside by rotating the rotation dish 40 horizontally, the second content C2 is applied to the skin or mixed with the first content (C1) to be applied to the skin.

Looking in detail at the open structure of the rotation dish 40 as described above, first, as shown in FIG. 5, the user pulls the rotation dish 40 from the rotation dish coupling member 30 forward by a predetermined section.

When the rotation dish 40 is pulled as described above, the fastening portion 322 of the axial rotation part 32 inserted into the fastening groove 422 of the axial rotation hole 42 is released from the fastening groove 422 while moving forward, and as the rotation part 324 of the axial rotation part 32 is continuously inserted into the rotation groove 424 of the axial rotation hole 42, the rotation plate 40 is rotatable.

In this case, as shown in the partially enlarged part of FIG. 5, while the locking protrusion 44 of the rotation dish 40 moves within the forward/backward movement groove 36 of the rotation dish coupling member 30, the locking protrusion 44 moves sequentially over the rear stopper protrusion 364 and the front stopper protrusion 362 to be rotatably positioned, so that the rotation dish 40 does not move forward or backward arbitrarily unless the user intentionally pushes the rotation dish 40 backward.

Thereafter, as shown in FIG. 6, when the rotation dish 40 is rotated in any one direction, the rotation dish 40 is rotated from the rotation dish coupling member 30. In this case, the locking protrusion 44 of the rotation dish 40 is resiliently moved up and down by the curved elastic slit 46, and as shown in the partially enlarged portion of FIG. 6, is released from the forward/backward movement groove 36 of the rotation dish coupling member 30 to be elastically inserted into the adjacent locking groove 34.

Thereafter, when the rotation dish 40 is further rotated, while being elastically moved up and down by the curved elastic slit 46, the locking protrusion 44 of the rotation dish 40 is sequentially inserted into the locking grooves 34 located in the rotation direction of the rotation dish 40. Therefore, it is possible to adjust the rotation angle of the rotation dish 40 to be constant, and it is possible to transfer more improved rotational feeling to the user.

Thereafter, as shown in FIG. 7, when the rotation dish 40 is rotated at 180 degrees, the second content C2 filled in the rotation dish 40 is completely exposed to the outside. In this case, the locking protrusion 44 of the rotation dish 40 is elastically inserted into the forward/backward movement groove 36, as shown in the partial enlarged portion of FIG. 7.

After the makeup is finished, the rotation dish 40 is rotated in the opposite direction to close, and the content container lid 25 and the container body lid 15 are sequentially closed, so that the use of the compact container having an improved opening/closing structure for different cosmetic materials according to one aspect of the present disclosure is completed.

As described above, the compact container having an improved opening/closing structure for different cosmetic materials described in this disclosure is an illustrative purpose only, and the present disclosure is not limited thereto. Thus, it should be understood that numerous other modifications and embodiments can be devised by those skilled in the art within the spirit and scope of the present disclosure and they will fall within the scope of the present disclosure.

What is claimed is:

1. A compact container having an improved opening and closing structure for different cosmetic materials, the compact container comprising:

a container body__provided on one side thereof with a container body lid;

a content container coupled inside the container body to contain a first content therein and provided at one side thereof with a content container lid;

a rotation dish coupling member coupled to a lower portion of the container body and formed with an axial rotation part;

a rotation dish coupled to a lower portion of the rotation dish coupling member to be horizontally rotatable and to contain a second content, and formed with an axial rotation hole; and a rotation shaft coupled to the axial rotation part of the rotation dish coupling member by passing through the axial rotation hole of the rotation dish, wherein a rotation of the rotation dish is allowed or restricted as the axial rotation part of the rotation dish coupling member and the axial rotation hole of the rotation dish are released from each other or fastened to each other by a forward or backward movement of the rotation dish.

2. The compact container of claim 1, wherein the axial rotation part of the rotation dish coupling member includes a fastening part protruding to one side and a curved rotation part formed on an opposite side of the fastening part, and the axial rotation hole of the rotation dish includes a fastening groove into which the fastening part is inserted and a rotation groove formed opposite to the fastening groove.

3. The compact container of claim 1, further comprising:

a locking groove formed adjacent to the axial rotation part of the rotation dish coupling member, and a locking protrusion formed adjacent to the axial rotation hole of the rotation dish, wherein the locking protrusion is inserted into the locking groove.

4. The compact container of claim 3, further comprising:

a curved elastic slit formed adjacent to the locking protrusion of the rotation dish such that the locking protrusion is elastically moved up and down.

5. The compact container of claim 1, further comprising:

a forward and backward movement groove formed on both sides of the axial rotation part of the rotation dish coupling member, and a locking protrusion formed adjacent to the axial rotation hole of the rotation dish, wherein the locking protrusion is inserted into the forward and backward movement groove.

6. The compact container of claim 5, further comprising:

a curved elastic slit formed adjacent to the locking protrusion of the rotation dish such that the locking protrusion is elastically moved up and down.

7. The compact container of claim 5, further comprising:

a front stopper protrusion and a rear stopper protrusion formed in the forward and backward movement groove to limit forward and backward movements of the rotation dish.

8. The compact container of claim 1, further comprising:

a separation preventing member for the rotation shaft, which is inserted into a center of the rotation shaft to prevent the rotation shaft from being separated from the rotation dish coupling member while being shrunk inward.

9. The compact container of claim 1, further comprising:

a lower plate coupled to the lower portion of the rotation dish.

10. The compact container of claim 9, wherein the lower plate and the rotation shaft are integrally formed.

11. The compact container of claim 1, wherein the axial rotation part formed in the rotation dish coupling member is released from the axial rotation hole formed in the rotation dish by pulling the rotation dish forward and a second content is exposed to an outside by horizontally rotating the rotation dish.

* * * * *